United States Patent [19]

Quealy

[11] Patent Number: 4,821,343

[45] Date of Patent: Apr. 18, 1989

[54] UPPER TORSO WEARING APPAREL

[76] Inventor: Judith F. Quealy, 1444 Harbor Dr., Sarasota, Fla. 34236

[21] Appl. No.: 201,837

[22] Filed: Jun. 3, 1988

[51] Int. Cl.[4] ..... A41D 1/04; A41B 9/02

[52] U.S. Cl. ..... 2/102; 2/106; 2/115; 2/403

[58] Field of Search ..... 2/102, 106, 115, 113, 2/403, 405, 408

[56] References Cited

U.S. PATENT DOCUMENTS

| | | | |
|---|---|---|---|
| 1,104,584 | 7/1914 | Vickers | 2/408 |
| 1,927,179 | 9/1933 | Levinsohn | 2/102 |
| 2,416,108 | 2/1947 | Lloyd | 2/405 |

FOREIGN PATENT DOCUMENTS

| | | | |
|---|---|---|---|
| 1084303 | 7/1954 | France | 2/408 |

*Primary Examiner*—H. Hampton Hunter

*Attorney, Agent, or Firm*—Charles J. Prescott

[57] ABSTRACT

Novelty wearing apparel fabricated from, or fabricated to have the appearance of, a man's lower torso tight-fitting underwear known as briefs inverted. The leg openings of the brief function to receive a wearer's arms, the waist of the briefs extends downwardly over the upper torso toward the waist, and the crotch of the briefs includes a neck aperture to receive the wearer's head and neck passing therethrough. The flyfront of the briefs may be adapted, by the orientation and shape of the neck, to be positioned against the chest or the back of the wearer as desired.

4 Claims, 1 Drawing Sheet

Fig. 4
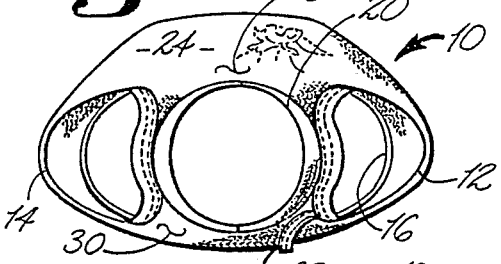
Fig. 5
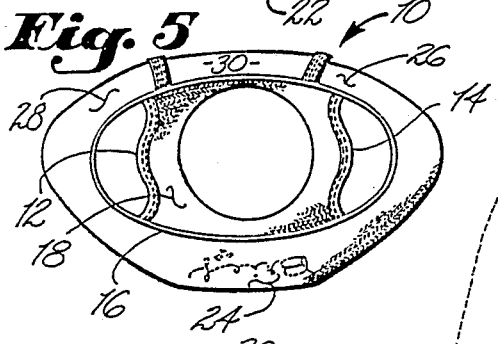
Fig. 1
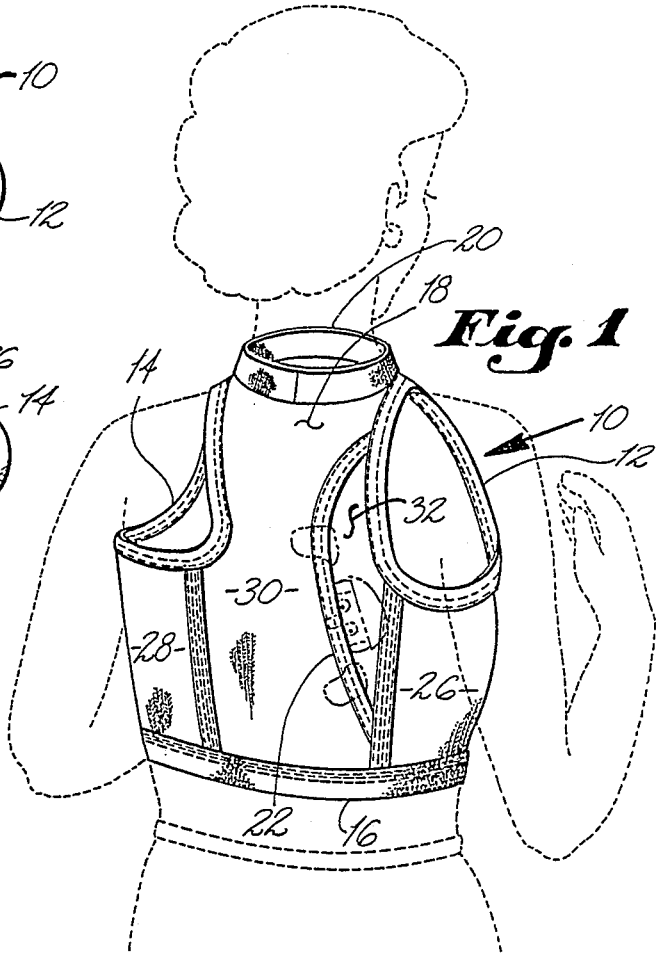
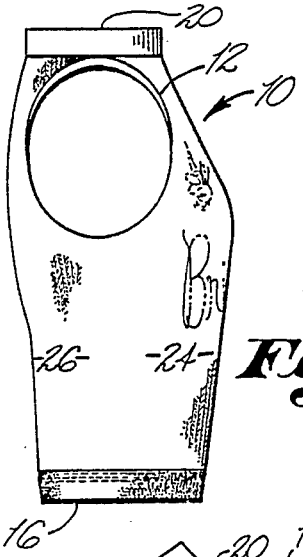
Fig. 6
Fig. 2
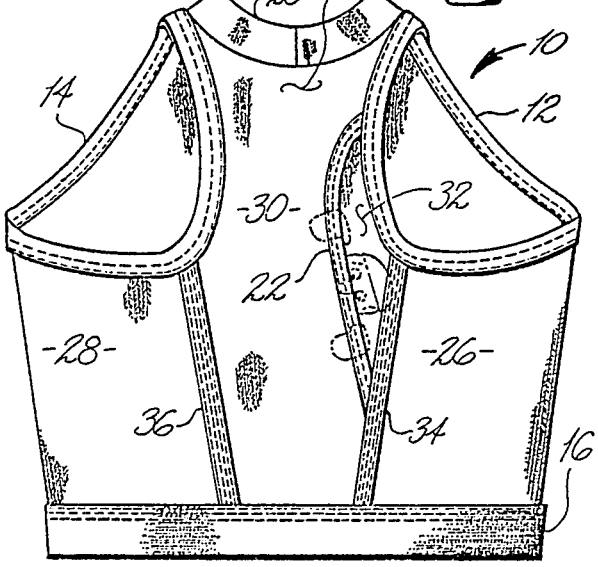
Fig. 3
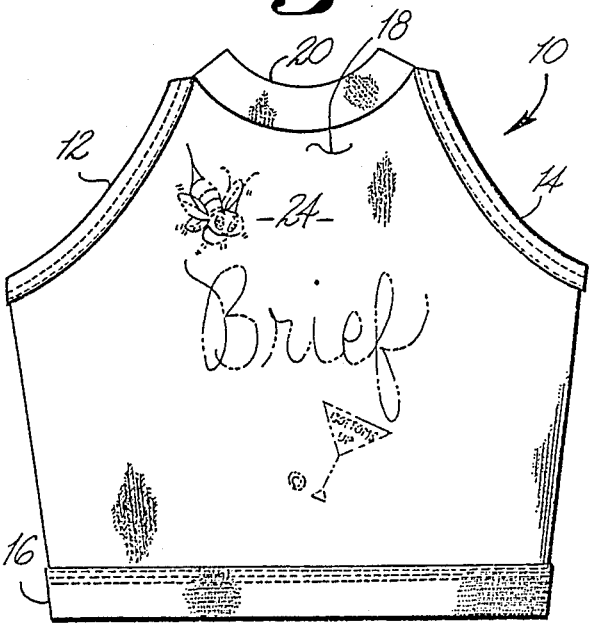

UPPER TORSO WEARING APPAREL

BACKGROUND OF THE INVENTION

This invention relates generally to wearing apparel, and more particularly to novelty upper torso wearing apparel.

In this age of funky clothing, there seems to be no end to the imagination of clothing designers to create new and unusual appearances and styles for clothing. Women, particularly, have a fascination for wearing clothing which is originally designed to be worn by men or to have the appearance of clothing designed to be worn by men.

Much of this novelty clothing appearance is directed to clothing which is either generally somewhat larger and baggy to provide that type of overall appearance or of another group of novelty clothing which is designed to be considerably more body tight, appealing to the slender and svelt female appearance which has also become extremely desirable and popular.

The present invention provides a novelty wearing apparel design which generally has the appearance of mens' lower underwear known as "briefs" which are adapted to be worn in an inverted orientation over the upper torso as a shirt.

BRIEF SUMMARY OF THE INVENTION

This invention is directed to novelty wearing apparel fabricated from, or fabricated to have the appearance of, a man's lower torso tight-fitting underwear known as briefs in their inverted orientation. The leg openings of the briefs function to receive a wearer's arms, the waist of the briefs extends downwardly over the upper torso toward the waist, and the crotch of the briefs includes a neck aperture to receive the wearer's head and neck passing therethrough. The flyfront of the briefs may be adapted, by the orientation and shape of the neck, to be positioned against the chest or the back of the wearer as desired.

It is therefore an object of this invention to provide a novelty upper torso wearing apparel, particularly adapted for women, having the overall appearance of mens' inverted briefs.

It is another object of this invention to provide novelty upper torso wearing apparel which may be easily fabricated from conventional mens' briefs.

It is yet another object of this invention to provide a sleeveless pull-over shirt for women which has the overall appearance of inverted mens' briefs.

In accordance with these and other objects which will become apparent hereinafter, the instant invention will now be described with reference to the accompanying drawings in which:

BRIEF DESCRIPTION OF THE DRAWINGS

FIG. 1 is a perspective view of the invention.
FIG. 2 is a rear elevation view of the invention.
FIG. 3 is a front elevation view of the invention.
FIG. 4 is a top plan view of the invention.
FIG. 5 is a bottom plan view of the invention.
FIG. 6 is a right side elevation view of the invention.

DETAILED DESCRIPTION OF THE INVENTION

Referring now to the drawings, the invention is shown in all figures generally at numeral 10 and, in the preferred embodiment, is fabricated of men's briefs or lower torso underwear typically made from flexible cotton blended material. These briefs include slanted leg openings 12 and 14 having a hem therearound and also include a waistband 16 which is generally elastic and snug fitting at the waist. Also included in the briefs is a flyfront 22 overlaping an underpanel 32 which provides a concealed frontal opening to accommodate male necessity.

Men's briefs are generally fabricated of a rear panel 24 which extends from the slanted leg openings 12 and 14 having crotch 18 therebetween downwardly to the waistband 16. This rear panel 24 extends around the sides to form a portion of the front panels at 26 and 28. The central front panel 30, extending from crotch 18 to waistband 16, is connected along seams 34 and 36 to portions 26 and 28 of rear panel 24. An underlayer 32 is connected to back portion 26 along hem 34 and along a segment of slanted leg opening 12 covered by flyfront 22 to form the frontal access required by men.

The invention 10 is formed of the above described briefs by the addition of a neck aperture 20 formed centrally in crotch 18. Preferably the neck aperture includes an elastic band or hem therearound as shown. Thus, when the modified briefs forming the invention 10 are inverted whereby the waistband 16 is downwardly disposed and leg apertures 12 and 14 are upwardly disposed, the garment may then be fitted over the wearer's upper torso as shown in FIG. 1.

Thus, the slanted leg openings 12 and 14 receive the wearer's arms passed therethrough and waistband 16 is downwardly disposed toward over the upper torso toward the waist of the wearer. The neck aperture 20 may be oriented in crotch 18 so that fly front 22 may be disposed either on the user's back or on the user's chest. However, because of the general configuration of back panel 24, the preferred embodiment disposes fly front 22 on the user's back, allowing this normal rear panel 24 configuration to uniquely adapt to the typical female chest configuration.

Of course, the fly front 22 is rendered useful only for novelty, and, therefore, provides a broad range of additional novelty design opportunities which may be included therewith typically as shown in phantom in FIGS. 1 and 2. Further, the back panel 24 of the briefs, now serving as the front portion of the invention 10, also provides a broad surface upon which an unlimited variety of decorative designs may be applied.

It should be emphasized that the preferred embodiment 10 of the invention is either fabricated from or is fabricated to have the appearance of tightly fitting, somewhat elastic mens briefs. This is desirable to create a certain tight-fitting novelty appearance as well as functional use of the garment (so it won't "ride up" during exercise). However, the broad concept of the invention would also apply to the similar adaptation and modification to virtually all forms of mens' lower torso underwear.

While the instant invention has been shown and described herein in what is conceived to be the most practical and preferred embodiment, it is recognized that departures may be made therefrom within the scope of the invention, which is therefore not to be limited to the details disclosed herein, but is to be accorded the full scope of the claims so as to embrace any and all equivalent apparatus and articles.

What is claimed is:

1. Novelty upper torso wearing apparel comprising:

an inverted man's underwear having a body portion including a front fly covering a frontal opening, leg openings and a waist opening including a waistband;

said inverted underwear also including a neck aperture between the leg openings disposed in the crotch of said underwear and opposingly spaced at the opposite end from the waistband of said underwear;

said neck aperture adapted to receive the wearer's head and neck passing therethrough when said inverted underwear is worn by placing arms through said leg openings and said waistband is pulled downwardly toward the wearer's waist.

2. Novelty upper torso wearing apparel as set forth in claim 1, wherein:

said man's underwear is briefs.

3. Novelty upper torso wearing apparel as set forth in claim 1, wherein:

said leg openings and said neck aperture are hemmed;

said waistband is elastic and adpated for snug fitting around the wearer's torso above the waist.

4. A novelty shirt adapted to be worn tightly fit by women comprising:

a body portion fabricated of flexible somewhat stretchable fabric structured to fit snuggly over a wearer's upper torso;

said body portion having diagonally disposed sleeveless arm holes separated by an upper panel having a neck aperture;

said body portion extending downwardly to an elastic waistband forming its lower margin; and a flyfront disposed in said body portion whereby said shirt is structured and oriented to resemble men's inverted briefs.

* * * * *